US012006607B2

(12) United States Patent
Damtew et al.

(10) Patent No.: US 12,006,607 B2
(45) Date of Patent: Jun. 11, 2024

(54) WASHING MACHINE VENTILATION STRUCTURE

(71) Applicant: Haier US Appliance Solutions, Inc., Wilmington, DE (US)

(72) Inventors: Fikreadam Abebe Damtew, Louisville, KY (US); Aaron Lee Welch, Louisville, KY (US); S. Neil Malone, Louisville, KY (US); James Quentin Pollett, Louisville, KY (US); Rushikesh Nandkumar Salvi, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 157 days.

(21) Appl. No.: 17/531,756

(22) Filed: Nov. 21, 2021

(65) Prior Publication Data

US 2023/0160122 A1 May 25, 2023

(51) Int. Cl.

| | |
|---|---|
| ***D06F 23/02*** | (2006.01) |
| ***D06F 39/06*** | (2006.01) |
| ***D06F 39/14*** | (2006.01) |

(52) U.S. Cl.

CPC ..... *D06F 23/02* (2013.01); *D06F 39/06* (2013.01); *D06F 39/14* (2013.01)

(58) Field of Classification Search

CPC ..... D06F 23/02; D06F 39/06; D06F 39/14
USPC ..... 68/139
See application file for complete search history.

(56) References Cited

U.S. PATENT DOCUMENTS

2019/0360144 A1* 11/2019 Sheeran ..... D06F 21/04

FOREIGN PATENT DOCUMENTS

| | | |
|---|---|---|
| JP | 2008000231 A | 1/2008 |
| JP | 5546979 B2 | 7/2014 |
| JP | 2019088717 A | 6/2019 |

OTHER PUBLICATIONS

JP2019088717A—machine translation (Year: 2019).*

* cited by examiner

*Primary Examiner* — Tinsae B Ayalew
(74) *Attorney, Agent, or Firm* — Dority & Manning, P.A.

(57) ABSTRACT

A washing machine appliance including a ventilation structure. A vent line is at a wash tub. A vent filter is provided to the vent line that allows air to flow from the wash tub, and through the vent line, the vent filter redirecting cleaning fluids impinging on the vent filter back toward the wash tub. The vent filter may include a plurality of louvers. The louvers may be located adjacent to one another so as to form a plurality of openings for the flow of air from the wash tub.

20 Claims, 12 Drawing Sheets

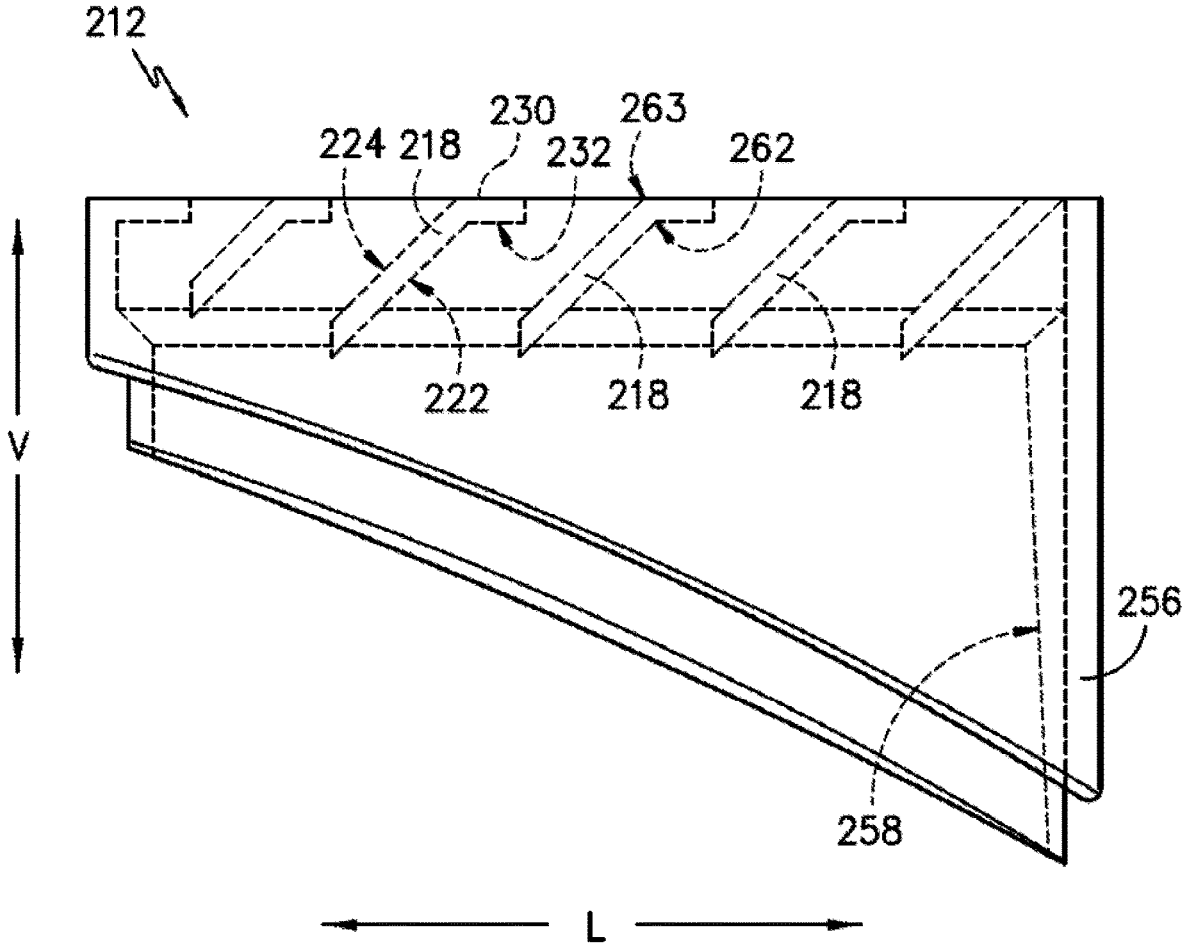
FIG. –5A–

WASHING MACHINE VENTILATION STRUCTURE

FIELD OF THE INVENTION

The present subject matter relates generally to washing machine appliances and, more particularly, to washing machine appliances having one or more ventilation features.

BACKGROUND OF THE INVENTION

Washing machine appliances generally include a wash tub for containing water or wash fluid (e.g., water, detergent, bleach, or other wash additives). A wash basket is rotatably mounted within the wash tub and defines a wash chamber for receipt of articles for washing. During normal operation of such washing machine appliances, the wash fluid is directed into the wash tub and onto articles within the wash chamber of the wash basket. The wash basket or an agitation element can rotate at various speeds to agitate articles within the wash chamber and to wring wash fluid from articles within the wash chamber.

Some existing washing machine appliances, such as horizontal axis washing machines or front load washing machines, may be provided with one or more ventilation features. Such features may allow a washing machine appliance to exchange air between the wash tub and the ambient environment. The exchange of air may be necessary to prevent moisture from accumulating within the wash tub. For example, if the wash tub is not ventilated, moist, stagnant air may form within the washing machine. Furthermore, ventilation may be required for pressure equalization during wash and rinse cycles of washing machines.

Challenges exist in ventilation features, however. Ventilation features are a potential pathway for cleaning fluids to exit the wash tub. For example, to wring wash or rinse fluid from articles in the wash chamber, the wash basket may rotate at a high speed to send fluid out of the wash basket through perforations and into an annulus between the wash basket and the wash tub. As wash fluid is sent out of the wash basket, sometimes at relatively high speed and in various directions, it may be directed out of ventilation features. Wash fluid would then be outside the wash tub, undesirably wetting other components of the washing machine and in extreme cases, depositing fluid outside of the appliance.

Accordingly, a washing machine appliance having the ability to remove moisture by use of ventilation features while also preventing wash liquids from exiting the wash tub would be useful. A ventilation feature that allowed air to exit the wash tub while deterring liquids from exiting the wash tub at the same time would be beneficial.

BRIEF DESCRIPTION OF THE INVENTION

Aspects and advantages of the invention will be set forth in part in the following description, or may be obvious from the description, or may be learned through practice of the invention.

In one exemplary embodiment, a front load washing machine appliance is provided. The washing machine appliance may include a cabinet, a wash tub positioned within the cabinet, and a wash basket. The wash basket may be rotatably mounted within the wash tub and may be accessible through an opening in the cabinet. The washing machine appliance may further include a door mounted to a front of the cabinet. The door may be moveable between an open position and a closed position for selectively controlling access to the wash basket. The washing machine appliance may further include a vent line extending from the wash tub. The vent line may provide for a flow of air along a flow direction from the wash tub. The vent line may have a vent inlet positioned at the wash tub. The washing machine appliance may further include a vent filter disposed at the vent inlet to the vent line. The vent filter may include a plurality of louvers located adjacent to each other and spaced apart from each other so as to form a plurality of openings for the flow of air from the wash tub. Each louver may include an upstream face and a downstream face along the flow direction, a bottom portion and a top portion along a vertical direction, and a top lip extending from the top portion. The top lip may have an upstream surface forming an obtuse or right angle with the upstream face. The upstream face may be positioned so that fluid ejected from the wash basket during rotation of the wash basket may impinge upon the upstream face to deter fluid from travelling through the vent line.

In another exemplary embodiment, a front load washing machine appliance is provided. The washing machine appliance may include a cabinet, a wash tub positioned within the cabinet, a wash basket rotatably mounted within the wash tub and accessible through an opening in the cabinet and a door mounted to a front of the cabinet. The door may be moveable between an open position and a closed position for selectively controlling access to the wash basket. The washing machine appliance may further include a vent line. The vent line may extend from the wash tub. The vent line may provide for a flow of air along a flow direction from the wash tub. The vent line may have a vent inlet positioned at the wash tub. The washing machine appliance may further include a vent filter disposed at the vent inlet to the vent line. The vent filter may include a plurality of louvers located adjacent to each other and spaced apart from each other so as to form a plurality of openings for the flow of air from the wash tub. Each louver may have an upstream face and a downstream face. Each louver may further have a bottom portion and a top portion along a vertical direction. Along the top portion, each louver may further include a top lip forming a non-zero angle with respect to the upstream face. The upstream face may be positioned so that fluid ejected from the wash basket during rotation of the wash basket may impinge upon the upstream face to block fluid from travelling through the vent line.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIGS. 5A, 5B and 5C illustrate an exemplary vent filter of the present invention in which FIG. 5A is side view, FIG. 5B is a perspective view, and FIG. 5C is a cross-sectional view.

FIGS. 6A and 6B illustrate another exemplary vent filter of the present invention in which FIG. 6A is side view and FIG. 6B is a perspective view.

FIGS. 7A and 7B illustrate another exemplary vent filter of the present invention in which FIG. 7A is side view and FIG. 7B is a perspective view.

FIGS. 8A and 8B illustrate another exemplary vent filter of the present invention in which FIG. 8A is side view and FIG. 8B is a perspective view.

Use of the same of similar reference numerals in the figures denotes the same or similar features unless the context indicates otherwise.

DETAILED DESCRIPTION

Figure 1:
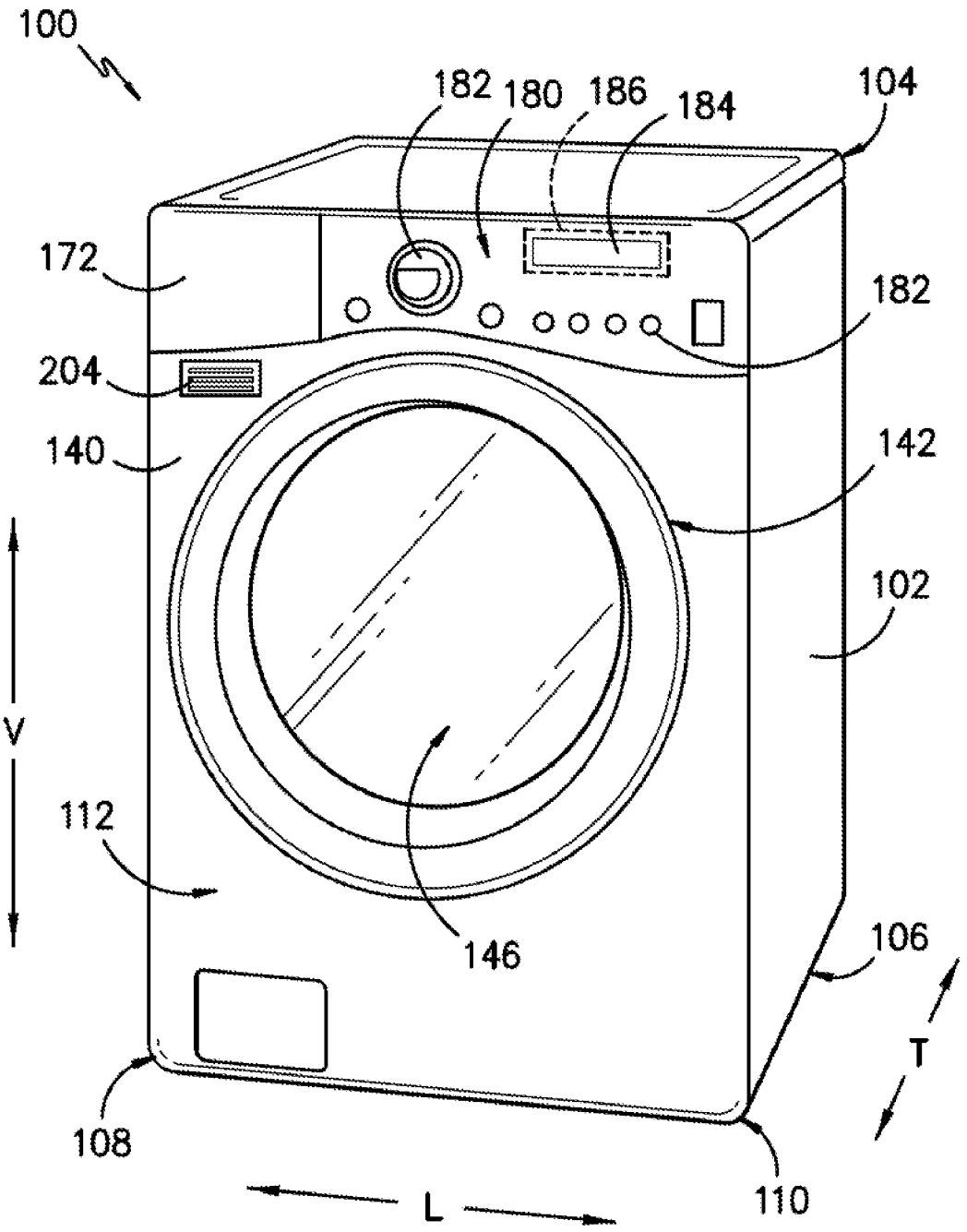
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
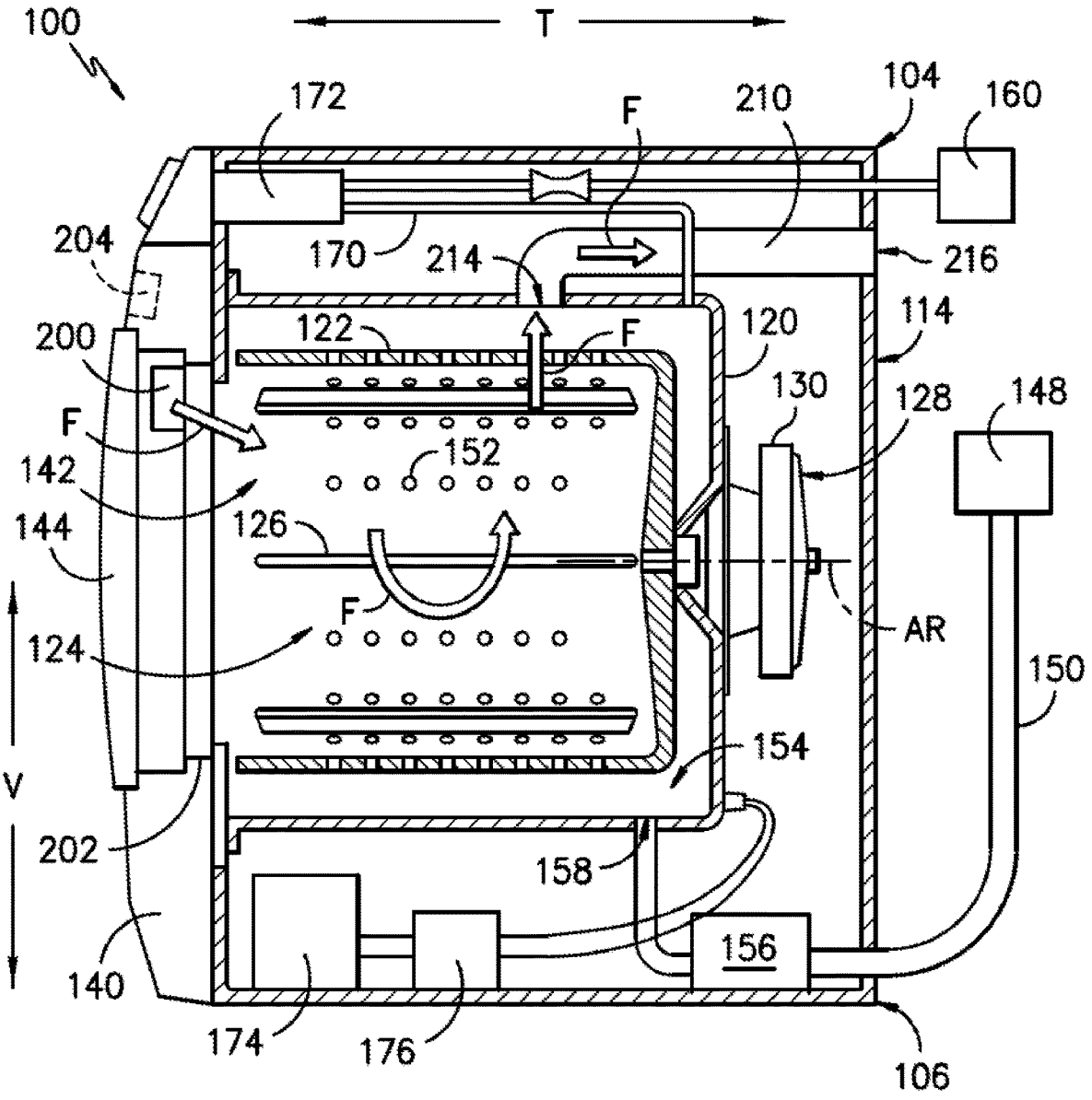
FIG. 2 provides a cross-sectional view of the exemplary washing machine appliance of FIG. 1 taken along a plane that includes the transverse and vertical directions.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T. Cabinet 102 is generally configured for containing or supporting various components of appliance 100 and which may also define one or more internal chambers or compartments of appliance 100. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

A wash tub 120 is positioned within a cabinet 102 and is generally configured for retaining fluids during an operating cycle. As used herein, such fluids may include a "cleaning fluid" or "wash fluid" having water, detergent, fabric softener, bleach, or any other suitable wash additive or combination thereof. Such fluids may also include a "rinse fluid" that includes water and may have one or more additives. The terms "wash fluid" and the like may be used herein to generally refer to a liquid used for washing or rinsing clothing or other articles. For example, the wash fluid is typically made up of water that may include other additives such as detergent, fabric softener, bleach, or other suitable treatments (including combinations thereof).

A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from wash basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor.

However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120.

A gasket 202 may be provided at opening 142 to seal door 144 when door 144 is in the closed position. For example, gasket 202 may extend between wash tub 120 and front panel 140, e.g., generally along the transverse direction T and may extend about or around opening 142 such that gasket 202 is covered by door 144 when door 144 is in the closed position, and gasket 202 may promote sealing between door 144 and cabinet 102, e.g., front panel 140 of cabinet 102 to help contain fluids including wash and rinse fluids.

In some embodiments, a window 146 (FIG. 1) in door 144 permits viewing of wash basket 122 and articles therein when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another portion of cabinet 102 or any other suitable support according to alternative embodiments.

Referring again to FIG. 2, wash basket 122 also defines a plurality of perforations 152 in order to facilitate fluid communication between an interior of wash basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from wash basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump or a circulation pump.

Pump assembly 156 is located beneath wash tub 120 and is in fluid communication with sump 154 for periodically discharging wash and rinse fluids from washing machine appliance 100. Pump assembly 156 may generally include a drain pump (not shown) which is in fluid communication with sump 154 and with an external drain 148 through a drain hose 150. During a drain cycle, drain pump in pump assembly 156 urges a flow of wash fluid from sump 154, through drain hose 150, and to external drain 148.

Referring still to FIGS. 1 and 2, in some embodiments, washing machine appliance 100 may include an additive dispenser or spout 170. For example, spout 170 may be in fluid communication with a water supply 160 in order to direct fluid (e.g., clean water) into wash tub 120. Spout 170 may also be in fluid communication with sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to or receive signals from controller 186.

In addition, the memory or memory devices of the controller 186 can store information or data accessible by the one or more processors, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, wash basket 122 may be motivated about the axis of rotation AR at a set speed (e.g., first speed or tumble speed). As wash basket 122 is rotated, articles within wash basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring fluid, (e.g., wash or rinse fluid) from the articles being washed. During a spin cycle, wash basket 122 is rotated at relatively high speeds. For instance, wash basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as wash basket 122 increases its rotational velocity such that the plaster speed maintains the articles at a generally fixed position relative to wash basket 122. After articles disposed in wash basket 122 are cleaned (or the washing operation otherwise ends), a user can remove the articles from wash basket 122 (e.g., by opening door 144 and reaching into wash basket 122 through opening 142).

It should be appreciated that the present subject matter is not limited to any particular style, or model of washing machine appliance. The exemplary embodiment depicted in FIGS. 1 and 2 is simply provided for illustrative purposes only. Other washing machine appliances having different configurations, different appearances, or different features may also be utilized with the present subject matter as well. For example, different locations may be provided for the user interface, different configurations may be provided, e.g., two in one wash and dry machine appliances, and other differences may be applied as well.

During wash and rinse cycles, a pressure difference can build in wash chamber 124 during rotation of wash basket 122. In accordance with exemplary aspects of the present disclosure, washing machine appliance 100 may include a vent damper 200 and vent line 210 to aid in equalization of pressure from within washing machine appliance 100.

Vent damper 200 may be provided to selectively control an air flow F between wash tub 120 and the exterior or environment of appliance 100. Generally, vent damper 200 is in fluid communication with wash tub 120 and vent line 210 as denoted by air flow path arrows F. In certain embodiments, vent damper 200 is enclosed, at least in part, within cabinet 102. Vent damper 200 may be selectively controlled or operated to permit or preclude the flow of air from the ambient environment into the interior of cabinet 102, such as to wash tub 120, during certain operations, phases, or cycles. Along air flow path F, vent damper 200 may be positioned between aperture 204 and wash tub 120 or between an aperture 204 and gasket 202. Opening vent damper 200 permits fluid communication or air flow into washing machine appliance 100.

For this exemplary embodiment, vent damper 200 is positioned upstream of the internal components, e.g., wash basket 122, with respect to a flow of ambient air F from the exterior of washing machine appliance 100. Accordingly, air flow F may travel through vent damper 200, into and through wash basket 122 and wash chamber 124 therein and may exit washing machine appliance 100 via vent line 210 by entering vent line 210 at a vent inlet 214, flowing through vent line 210, and returning to the exterior via vent outlet 216. Such air flow may be created by convective flow or rotation of wash basket 122. For example, rotation of wash basket 122, including ribs 126 therein, can create centrifugal forces pushing the air around to promote circulation of the ambient air through washing machine appliance 100, e.g., into and through wash basket 122 along air flow F. In some embodiments, a fan (not shown), may aid in the flow of air F through washing machine appliance 100. In other exemplary embodiments, washing machine 100 may have other air flow systems having different configurations and features.

For this exemplary embodiment, vent line 210 extends between wash tub 120 and cabinet 102. Vent inlet 214 is located at wash tub 120 near an outer circumferential surface 240 of wash tub 120. As used herein, the term "at" may include touching, nearby, positioned coincident with, or immediately adjacent to. Vent line 210 extends in the transverse direction T and ends at vent outlet 216. Vent line 210 maybe cylindrical in shape, may be constructed from a conduit, may include various bends or other configurations as desired for specific embodiments. Other shapes and constructions may be used as well. For this exemplary embodiment, vent outlet 216 of vent line 210 is located at back 114 of cabinet 102. Vent outlet 216 may be located at any other discrete position on cabinet 102, including top 104, bottom 106, left side 108, right side 110, or front 112. Regardless of location, vent outlet 216 allows air flow F to flow out of vent line 210 and out of washing machine appliance 100.

In some embodiments, vent line 210 may be located at wash tub 120. Vent line 210 may allow air to flow from wash tub 120. In some embodiments, vent line 210 may have a vent outlet (not shown) that is within cabinet 102. In certain embodiments, vent line 210 may have a return flow pattern, allowing air to flow from wash tub 120, into vent line 210 and then out of vent line 210 at a vent outlet that returns to a position on wash tub 120 separate from a position of a vent inlet along vent line 210 positioned on wash tub 120.

Figure 3:
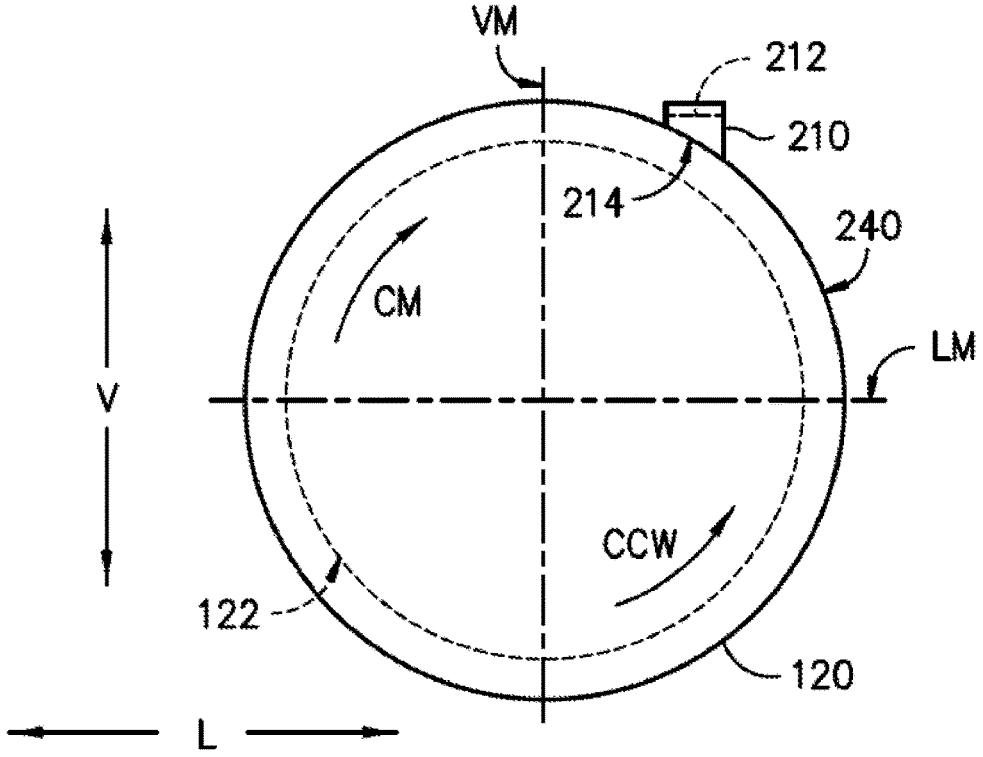
FIGS. 3 and 4 provide front schematic views and of an exemplary wash tub and wash basket depicting exemplary placements of a vent line.
Figure 4:
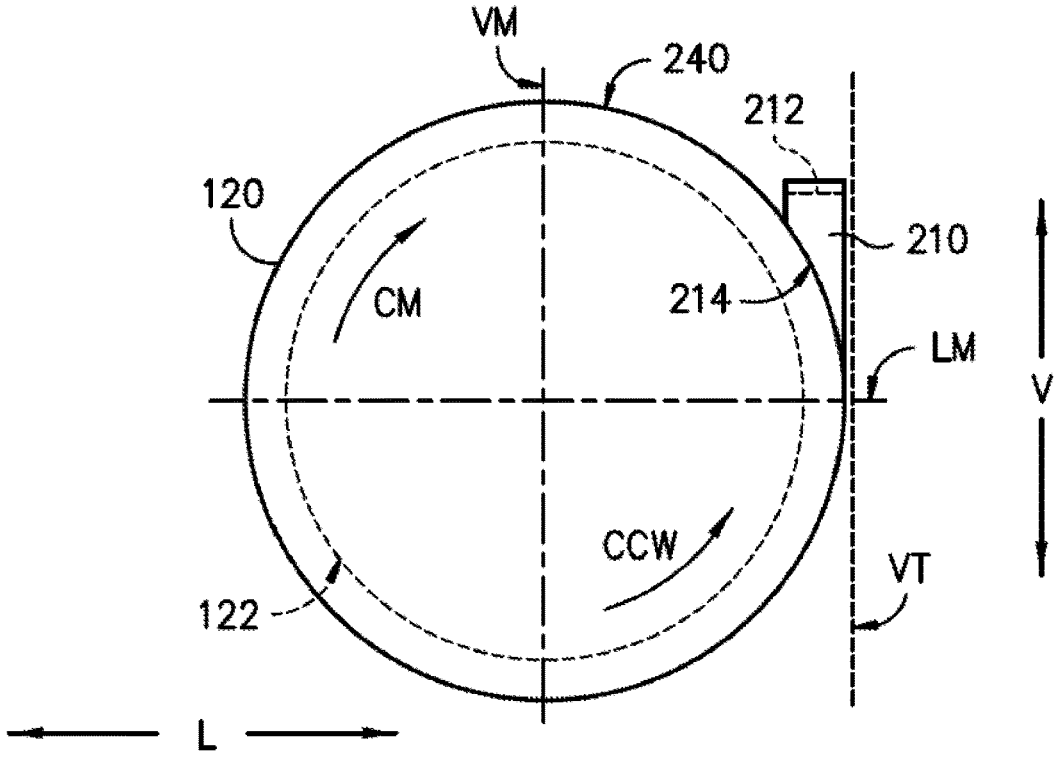

Referring to FIGS. 3 and 4, for this exemplary embodiment, vent inlet 214 of vent line 210 is positioned above a lateral midline LM of wash basket 122 and may be positioned anywhere along lateral direction L between, or coincident with, a vertical midline VM and a vertical tangent VT to outer circumferential surface 240 of wash tub 120. FIGS. 3 and 4 illustrate exemplary placements for vent inlet 214. In FIG. 3, vent inlet 214 is located at wash tub 120 near wash basket 122, and at a point midway along lateral direction L between vertical midline VM and vertical tangent VT. In FIG. 4, vent inlet 214 is located immediately adjacent to vertical tangent VT of wash tub 120. Other positions may be used as well.

As discussed above, during rotation of wash basket 122, fluid can be urged by centrifugal forces from wash basket 122 through perforations 152. Such fluid could undesirably enter vent line 210, which is not intended as a pathway for cleaning fluids (e.g., wash or rinse fluid) to exit wash tub 120. Accordingly, in accordance with exemplary aspects of the present disclosure, washing machine appliance 100 may further include a vent filter 212 to allow air to flow through washing machine appliance 100 while keeping cleaning fluids (e.g., wash or rinse fluid) within wash tub 120.

Figure 5B:
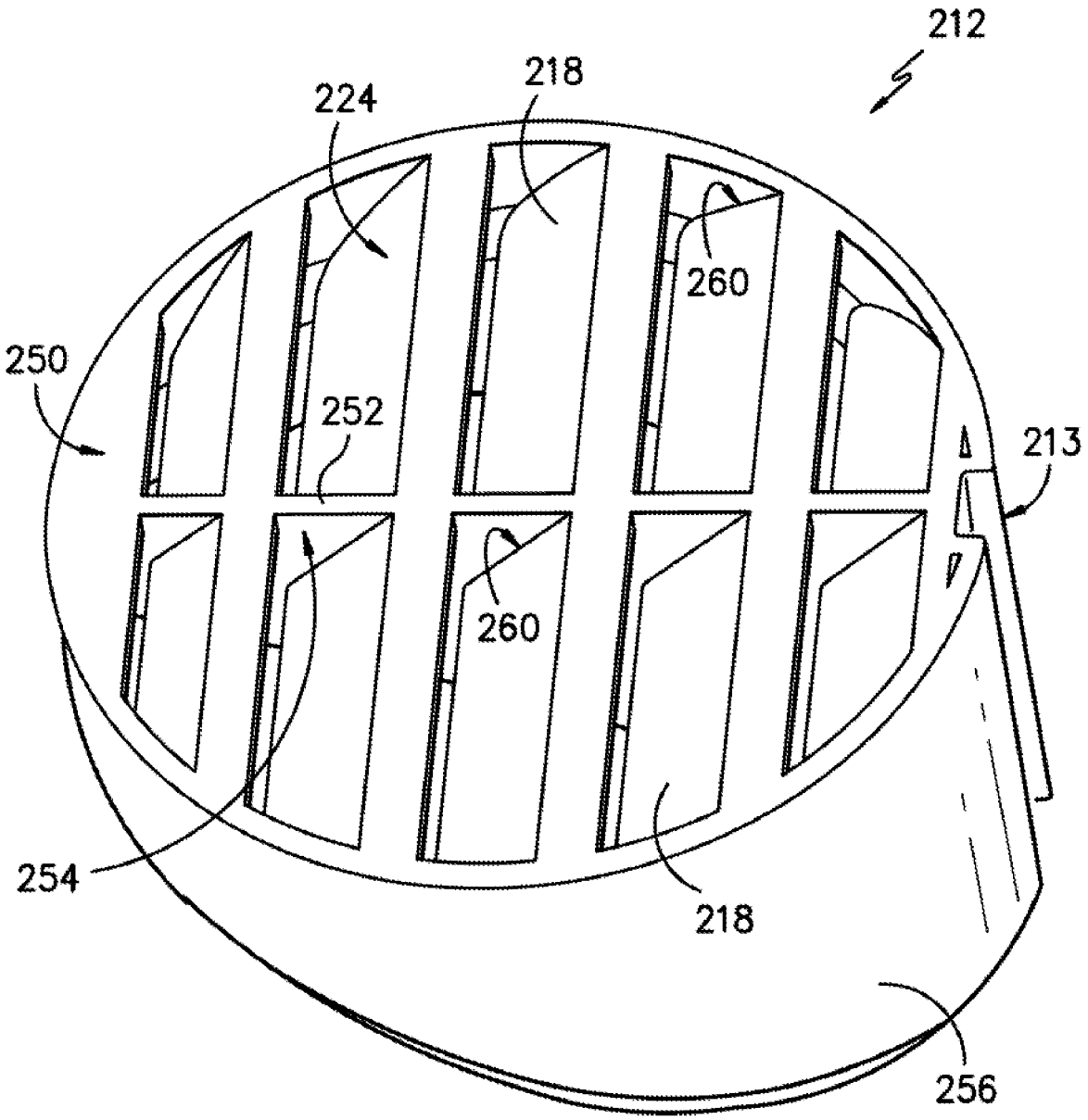
Figure 5C:
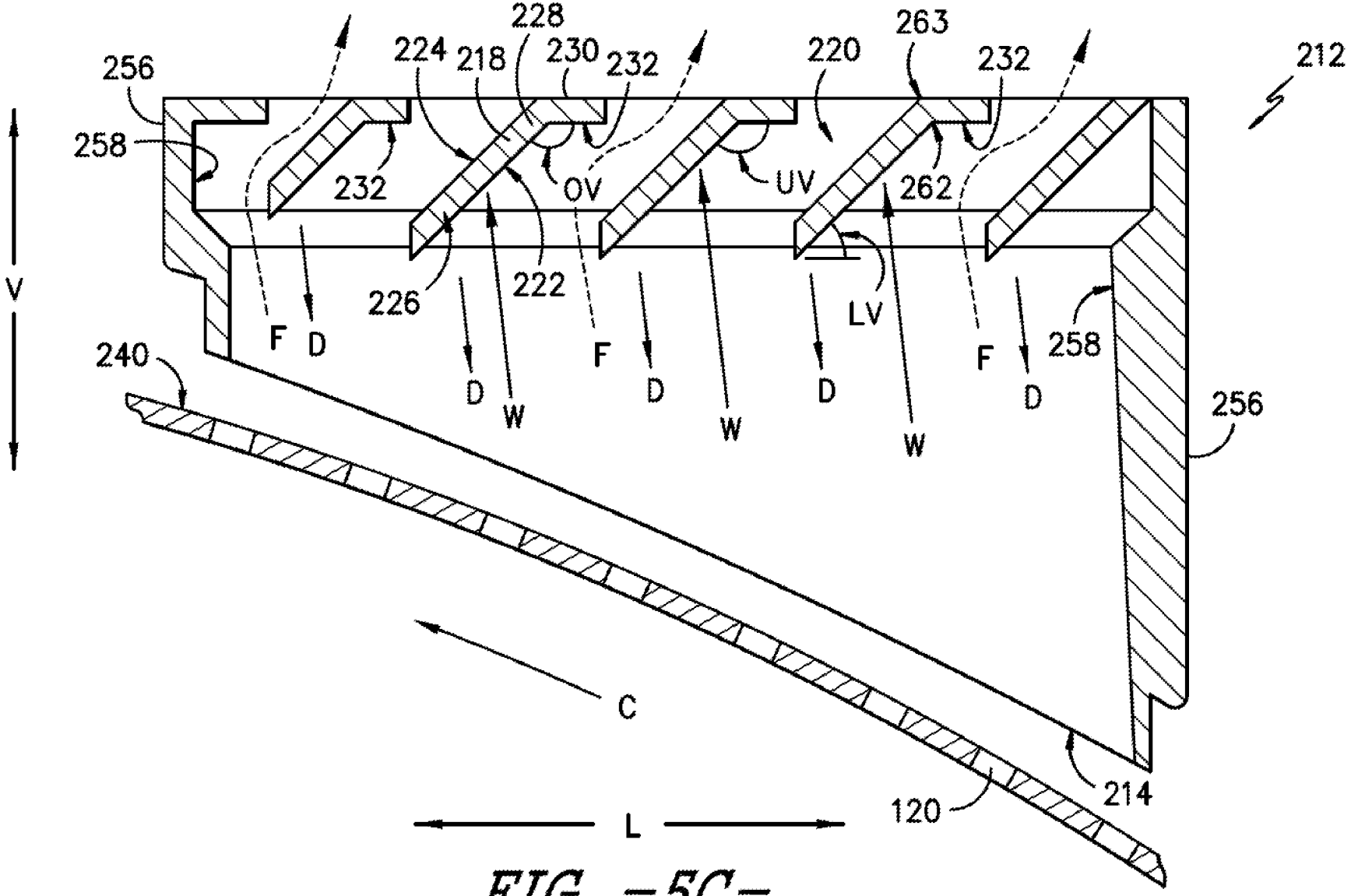

FIGS. 5A, 5B, and 5C, illustrate an exemplary embodiment of a vent filter 212 disposed at vent inlet 214. Vent filter 212 is located at wash tub 120 near outer circumferential surface 240 of wash tub 120. For this exemplary embodiment, vent filter 212 is configured as internal feature within vent line 210. Vent filter 212 may be insertable within vent line 210 using, for example, a groove 213 in a vent filter casing 256 for orientation. In some embodiments, vent filter 212 connects with vent line 210 with clips, snaps, screws, threaded ends, bent ends, or other shaped end to fit with vent line 210. For this embodiment, vent filter 212 lies within a plane that includes lateral direction L and transverse direction T.

Vent filter 212 is positioned to allow air flow F out of wash tub 120 and through vent line 210 while deterring fluids (arrows W), such as wash or rinse liquids, from travelling along flow path F through vent line 210. To aid in deterring fluid W from flowing through while allowing air flow F to pass through vent line 210, vent filter 212 includes a plurality of louvers 218 located adjacent to each other and spaced apart from each other in an equidistant manner so as to form a plurality of openings 220 for the flow of air F from wash tub 120 through vent line 210. Vent filter casing 256 includes an inside circumferential surface 258 to which each louver 218 is attached at ends 260.

For this exemplary embodiment, louvers 218 are divided by a central beam 252 located in the middle of filter 212 and extending between opposing sides of vent filter casing 256. Central beam 252 has a connecting surface 254 to which louvers 218 are connected. Connecting surface 254 lies in a vertical plane. Each louver 218 has two ends 260, a first end 260 attached to central beam 252 at connecting surface 254 and a second end 260 attached to vent filter casing 256 at circumferential surface 258.

Relative to air flow direction F, louvers 218 include an upstream face 222 and a downstream face 224. Upstream face 222 faces generally toward wash tub 120. Upstream face 222 is upstream in relation to air flow F such that air flow F and liquid or fluid flow F generally encounters upstream face 222 before downstream face 224. Stated alternatively, upstream face 222 faces oncoming air flow F as it travels to vent line 210. Upstream face 222 is positioned so that fluid ejected from wash basket 122 impinges upon upstream face 222 to deter fluids W from passing into or through vent line 210. For this exemplary embodiment, upstream face 222 is planar and forms a louver angle LV with the horizontal direction. In certain embodiments, upstream angle LV is in a range between about 30 and about 60 degrees. In certain embodiments, upstream angle LV is about 45 degrees.

Each louver 218 further includes a bottom portion 226 and a top portion 228 that are offset from each other along vertical direction V. In general, top portion 228 is a vertically upper portion of louver 218 while bottom portion 226 is a vertically lower portion. Top portion 228 is along an upper half of louver 218 while bottom portion 226 is a vertically lower half of louver 218. Both top portion 228 and bottom portion 226 attach to central beam 252 at connecting surface 254 and attach to vent filter casing 256 at circumferential surface 258.

A top lip 230 extends from top portion 228 and has an upstream surface 232 that extends upstream face 222 of each louver 218. For this exemplary embodiment, upstream surface 232 extends outwardly and horizontal—i.e., parallel to lateral direction L and transverse direction T. Upstream surface 232 forms an upstream angle UV (FIG. 5C) with upstream face 222 to create a top corner 262 between top lip 230 and top portion 228. As shown, upstream angle UV is an obtuse angle. In certain embodiments, upstream angle UV may be between about 120 and about 150 degrees. In certain other embodiments, upstream angle UV is about 135 degrees. Top lip 230 aids in redirecting fluid impinging on louver 218 toward wash tub 120, while allowing air flow along air flow path F to flow past top lip 230 and through vent line 210.

Referring particularly to FIG. 5C, during operation of appliance 100, fluid W ejected from wash basket 122 during rotation in a counter-clockwise direction (CCW in FIGS. 3 and 4) impinges upon upstream face 222 and upstream surface 232, which are configured (e.g., angled relative to vertical direction V) to deter fluids from entering vent line 210. Fluids impinging on upstream face 222 and upstream surface 232 fall back toward wash tub 120 as indicated by arrows D. As will be understood by one of skilled in the art using the teachings disclosed herein, the present invention is not limited to wash basket 122 that is only rotated in counter-clockwise direction (arrows CCW in FIGS. 3 and 4) and may be used with rotations in a clock-wise direction (arrows CW in FIGS. 3 and 4) as well. Vent inlet 214 may be located on either side of vertical midline VM along lateral direction L.

Figure 6A:
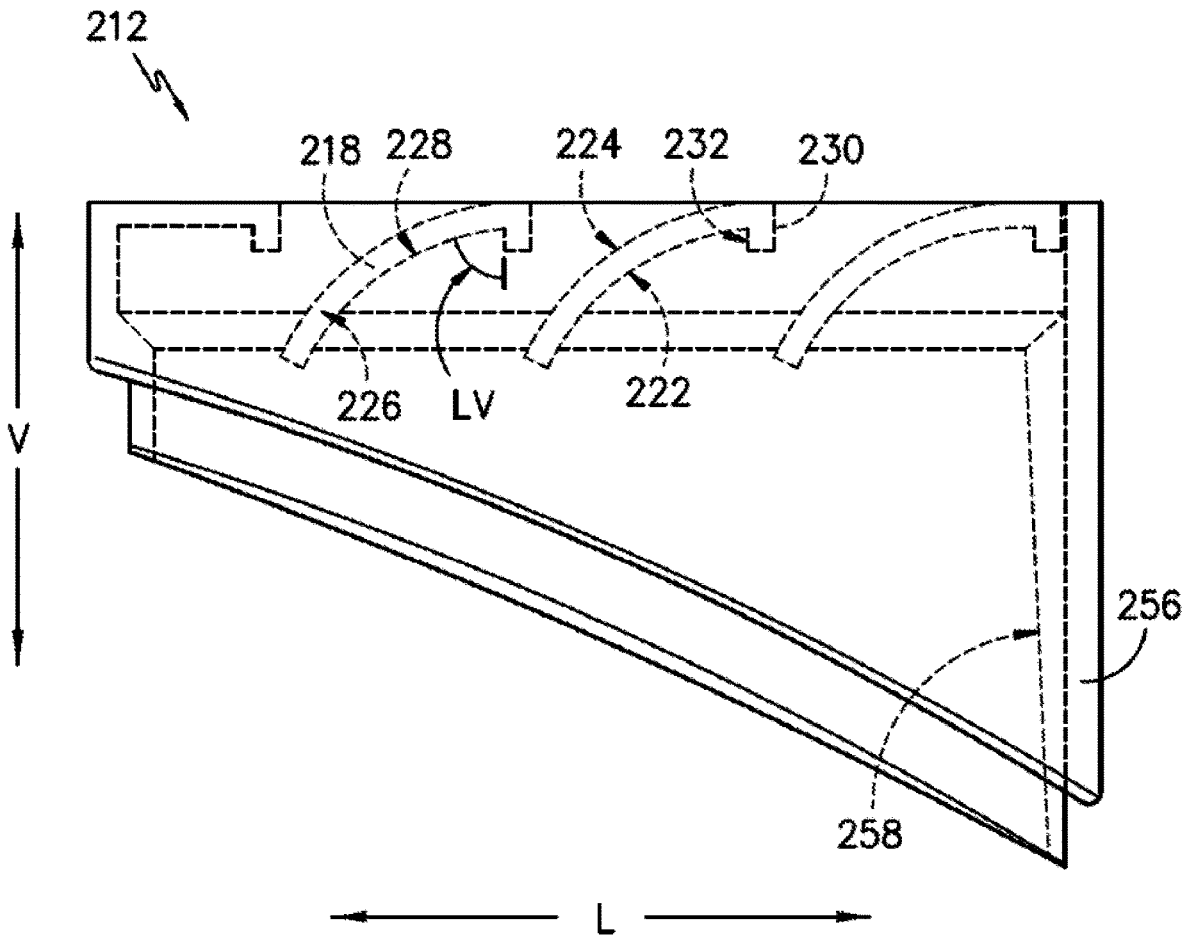
Figure 6B:
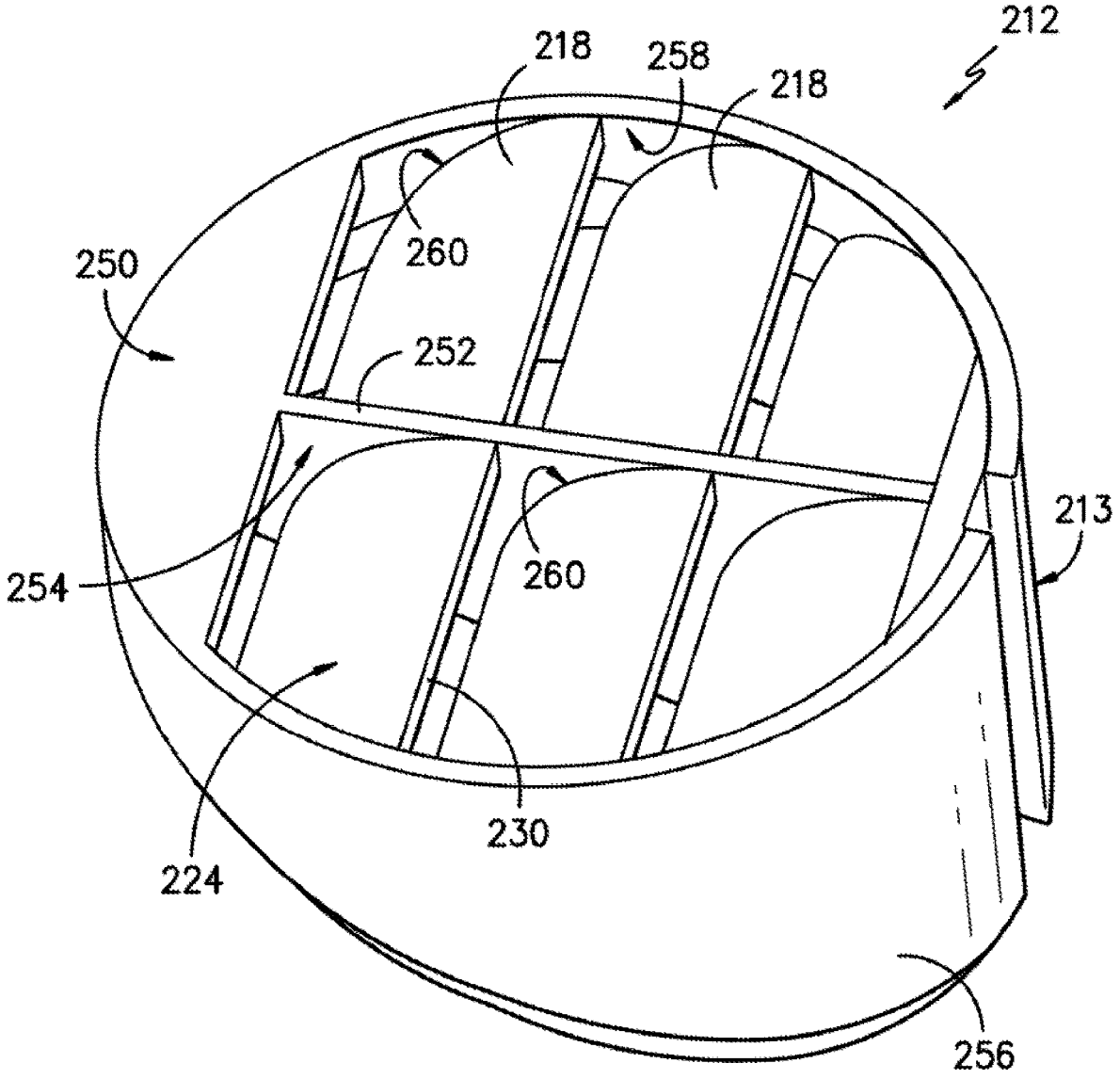

For the exemplary embodiment of FIGS. 5A through 5C, upstream face 222 is planar. FIGS. 6A and 6B illustrates another embodiment of filter 212 in which upstream face 222 of louvers 218 is curved. In addition, for this embodiment, top lip 230 extends downwardly from top portion 228 and parallel to vertical direction V—thereby providing an upstream surface 232 that is parallel to vertical direction V.

Figure 7A:
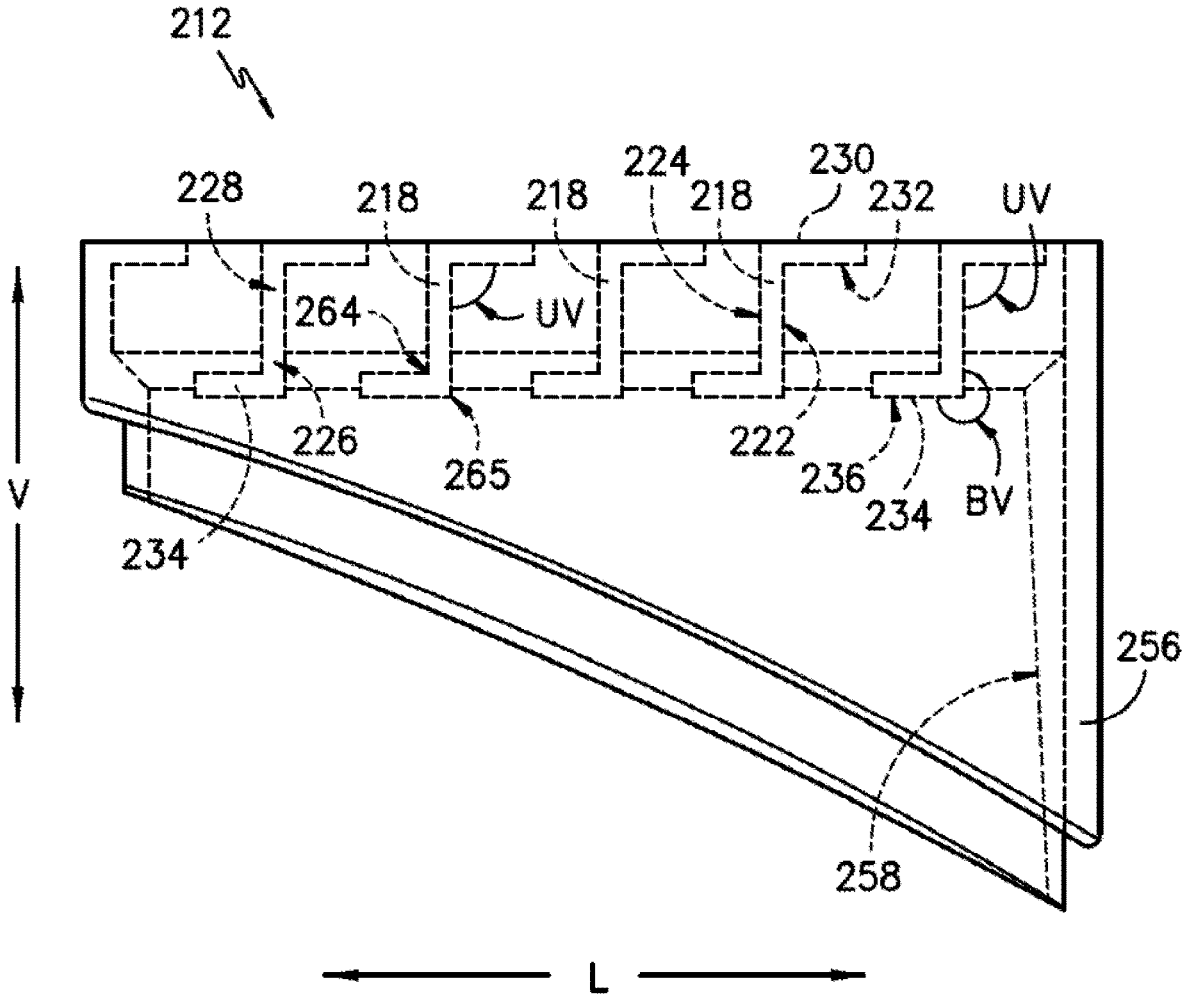
Figure 7B:
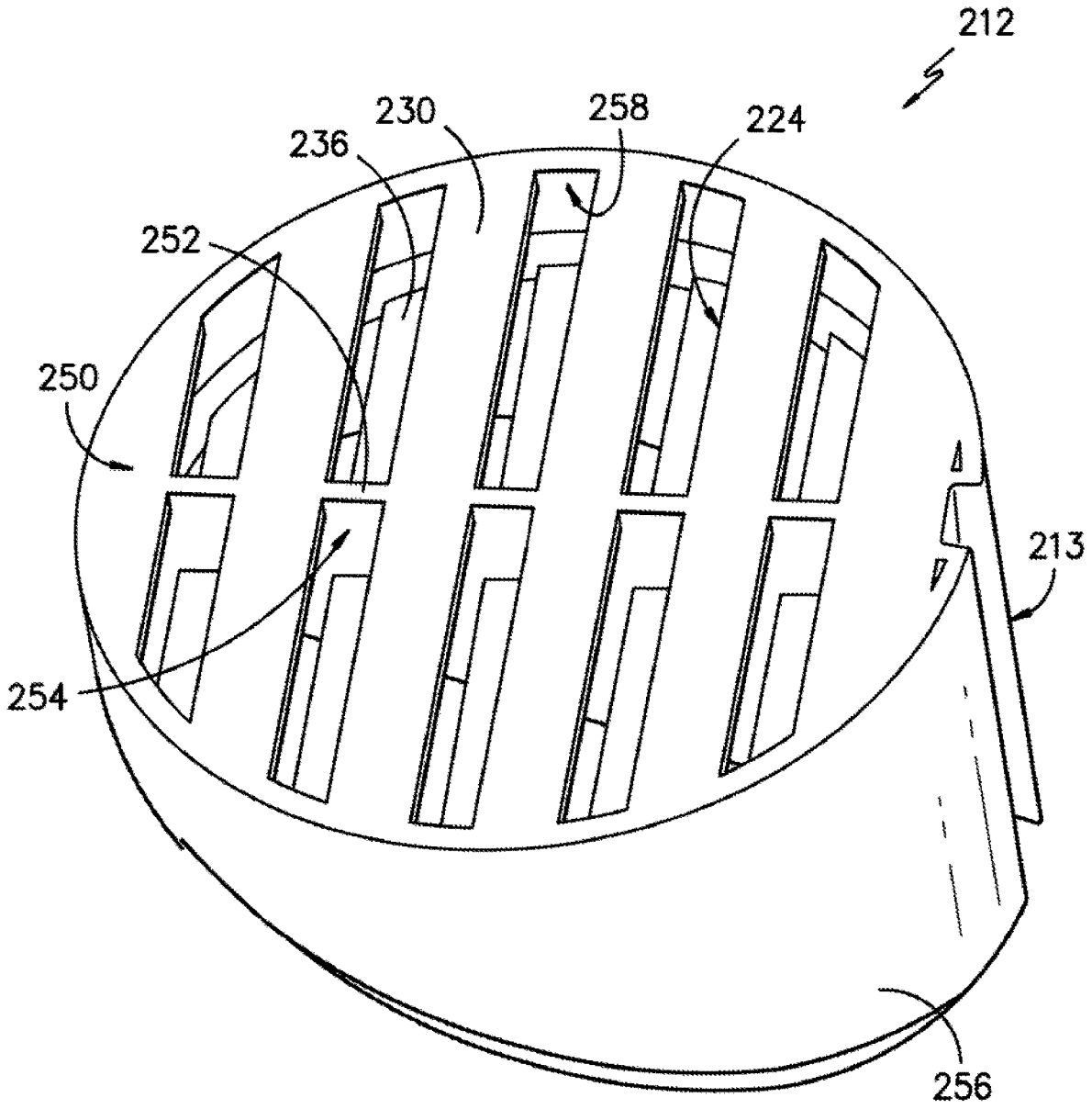

FIGS. 7A and 7B illustrates another exemplary embodiment of filter 212 in which upstream face 222 of louvers 218 is planar. As with the embodiment of FIGS. 5A through 5C, top lip 230 extends from top portion 228 and provides an upstream surface 232 that extends upstream face 222 of each louver 218. Upstream surface 232 extends outwardly and horizontal—i.e., parallel to lateral direction L and transverse direction T. Upstream surface 232 forms an upstream angle UV with upstream face 222 to create top corner 262 between top lip 230 and top portion 228. As shown, for this exemplary embodiment, upstream angle UV forms a right angle or an angle of 90 degrees.

Additionally, for the embodiment of FIGS. 7A and 7B, each louver 218 further includes a bottom lip 234 forming a bottom corner 264 with bottom portion 226 on each louver 218. Bottom lip 234 extends from bottom portion 226, in a direction opposite to the direction top lip 230 extends from top portion 228. Bottom lip 234 may be parallel to top lip 230 as shown.

Bottom lip 234 has a bottom upstream surface 236. Bottom upstream surface 236 of bottom lip 234 extends along a direction that is parallel to the horizontal direction or lies in a plane include the lateral and transverse directions. Bottom upstream surface 236 forms a bottom angle BV with upstream face 222. Bottom angle BV is a reflex angle. Bottom lip 234 further forms bottom corner 264 with downstream face 224. Bottom corner 264 is an inner corner. Bottom lip 234 forms a bottom outer corner 265 between bottom upstream surface 236 and upstream face 222. Bottom lip 234 aids in redirecting fluid impinging on louver 218 toward wash tub 120, while allowing air flow along air flow path F to flow past bottom lip 234 and through vent line 210. Bottom lip 234 is further offset from top portion 228 and top lip 230 along vertical direction V.

Figure 8A:
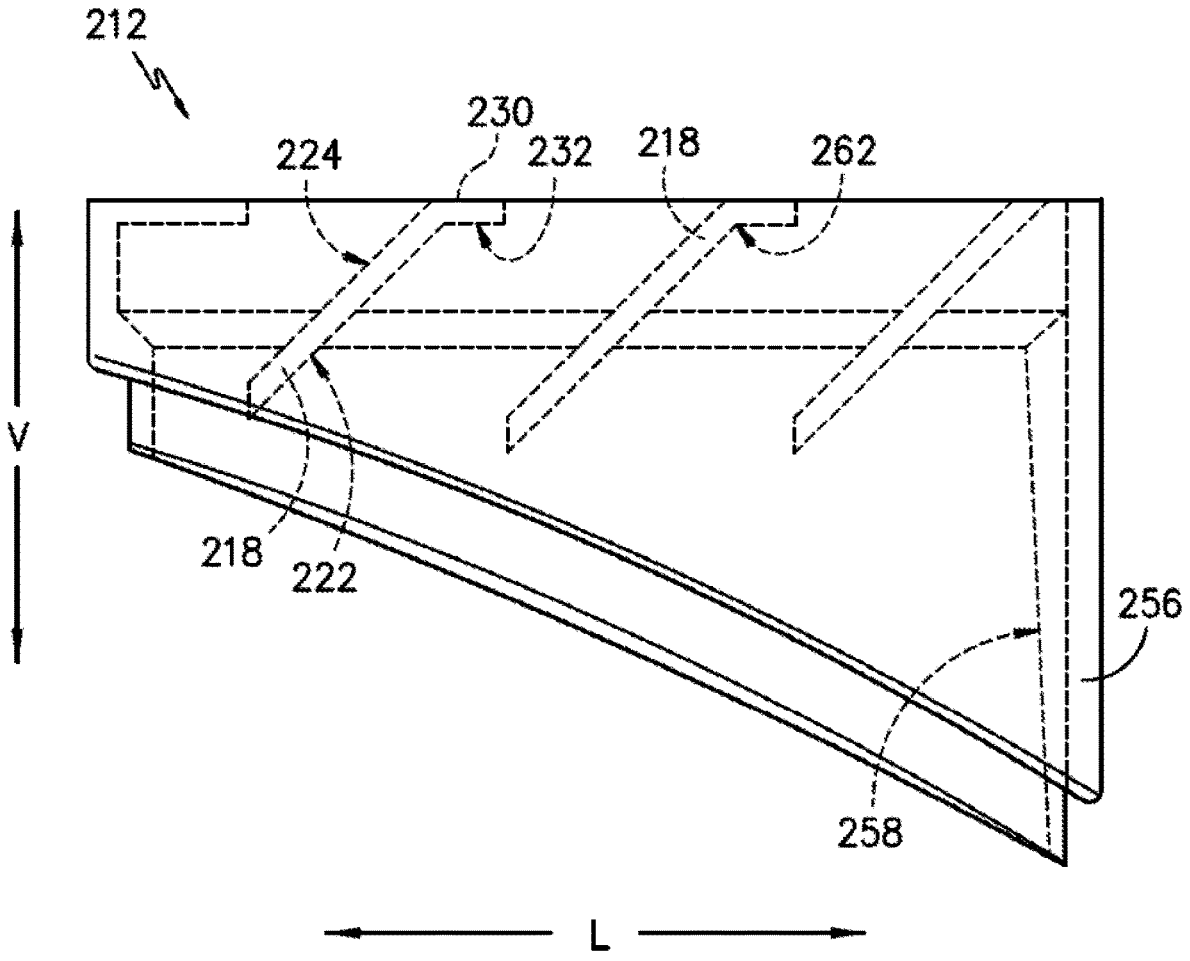
Figure 8B:
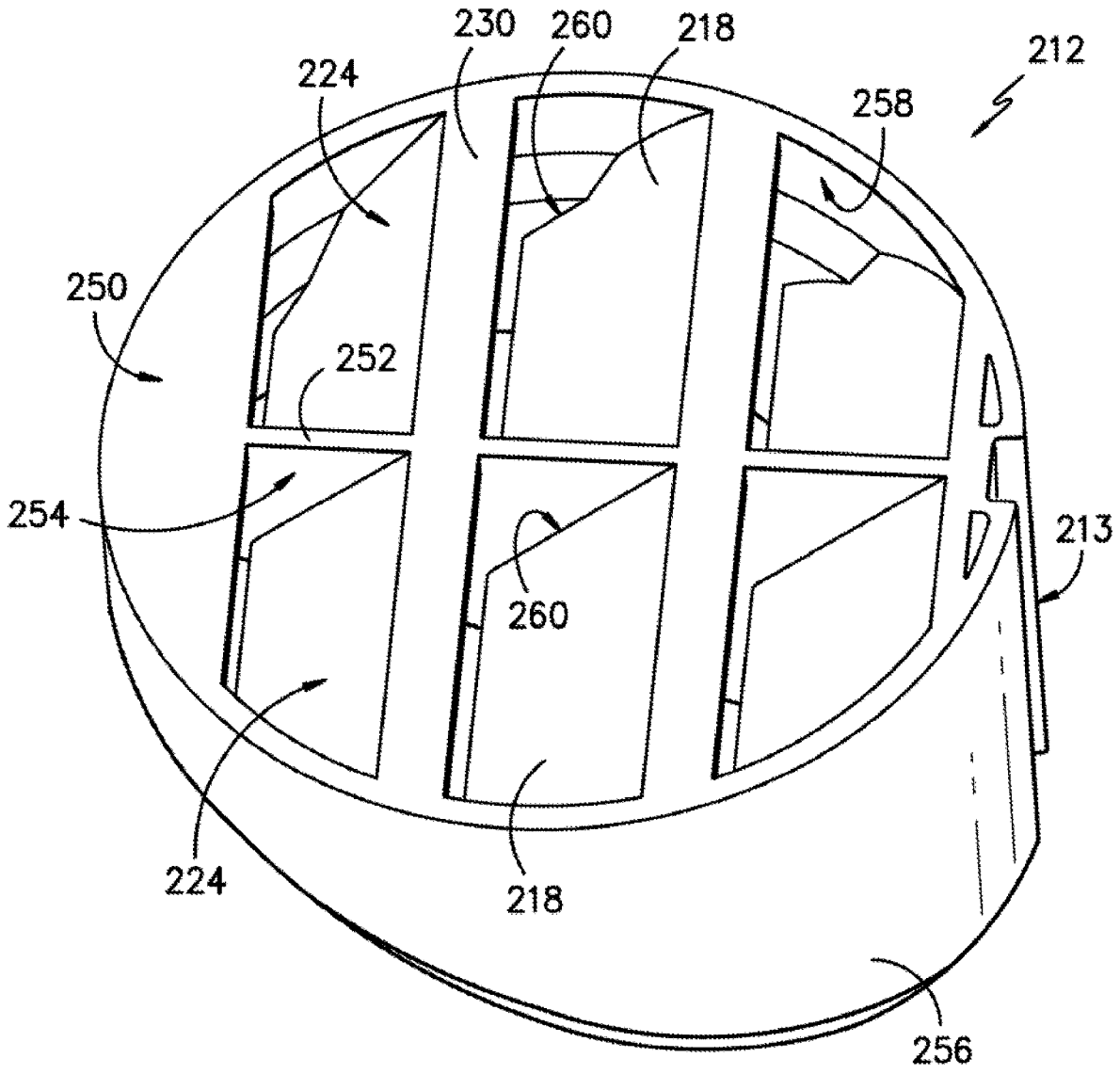

In other embodiments of the invention, the configuration of louvers 218 in filter 212 may be varied in other aspects including, e.g., the number of louvers, shape of each louver, and relative physical dimensions. For example, FIGS. 8A and 8B provide another exemplary embodiment of filter 212 in which louvers 218 have a different overall length and vary in number from previous embodiments. The increased length may improve the ability to redirect fluids back towards wash tub 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A front load washing machine appliance, the washing machine appliance comprising:
- a cabinet;
- a wash tub positioned within the cabinet;
- a wash basket rotatably mounted within the wash tub and accessible through an opening in the cabinet;
- a door mounted to a front of the cabinet and movable between an open position and a closed position for selectively controlling access to the wash basket;
- a vent line extending from the wash tub, the vent line providing for a flow of air along a flow direction from the wash tub, the vent line having a vent inlet positioned at the wash tub; and
- a vent filter disposed at the vent inlet to the vent line, the vent filter comprising a plurality of louvers located adjacent to each other and spaced apart from each other so as to form a plurality of openings for the flow of air from the wash tub, each louver comprising
  - an upstream face and a downstream face along the flow direction;
  - a bottom portion and a top portion along a vertical direction; and
  - a top lip extending from the top portion, the top lip having an upstream surface forming an obtuse or right angle with the upstream face,
  - wherein the upstream face is positioned so that fluid ejected from the wash basket during rotation of the wash basket impinges upon the upstream face to deter fluid from travelling through the vent line.

2. The front load washing machine appliance of claim 1, wherein the upstream surface of the top lip extends outwardly and parallel to a horizontal direction.

3. The front load washing machine appliance of claim 1, wherein the upstream surface of the top lip extends downwardly from the top portion and parallel to a vertical direction.

4. The front load washing machine appliance of claim 1, wherein the vent filter further comprises a vent filter casing having a groove.

5. The front load washing machine appliance of claim 1, wherein the upstream face is planar.

6. The front load washing machine appliance of claim 1, wherein the upstream face is curved.

7. The front load washing machine appliance of claim 1, wherein each louver further comprises
- a bottom lip extending from the bottom portion, the bottom lip having a bottom upstream surface forming a reflex angle with the upstream face.

8. The front load washing machine appliance of claim 7, wherein the bottom upstream surface of the bottom lip extends along a direction that is parallel to a horizontal direction.

9. The front load washing machine appliance of claim 1, wherein the wash tub includes an outer circumferential surface, wherein the vent inlet of the vent line is positioned coincident with, or immediately adjacent to, a vertical tangent to the outer circumferential surface of the wash tub.

10. A front load washing machine appliance, the washing machine appliance comprising:
- a cabinet;
- a wash tub positioned within the cabinet;
- a wash basket rotatably mounted within the wash tub and accessible through an opening in the cabinet;

a door mounted to a front of the cabinet and movable between an open position and a closed position for selectively controlling access to the wash basket; and a vent line extending from the wash tub, the vent line providing for a flow of air along a flow direction from the wash tub, the vent line having a vent inlet positioned at the wash tub;

a vent filter disposed at the vent inlet to the vent line, the vent filter comprising a plurality of louvers located adjacent to each other and spaced apart from each other so as to form a plurality of openings for the flow of air from the wash tub; and wherein each louver has an upstream face;

wherein each louver has a downstream face;

wherein each louver has a bottom portion and a top portion along a vertical direction;

wherein along the top portion each louver further comprises a top lip forming a non-zero angle with respect to the upstream face; and wherein the upstream face is positioned so that fluid ejected from the wash basket during rotation of the wash basket impinges upon the upstream face to block the fluid from travelling through the vent line.

11. The front load washing machine appliance of claim 10, wherein the top lip extends along a direction that is parallel to a horizontal direction.

12. The front load washing machine appliance of claim 10, wherein the top lip extends along a direction that is parallel to a vertical direction.

13. The front load washing machine appliance of claim 10, wherein the vent filter further comprises a vent filter casing having a groove.

14. The front load washing machine appliance of claim 10, wherein the upstream face is planar.

15. The front load washing machine appliance of claim 10, wherein the upstream face is curved.

16. The front load washing machine appliance of claim 10, wherein along the bottom portion each louver further comprises a bottom lip bent at a non-zero angle from the upstream face.

17. The front load washing machine appliance of claim 16, wherein the bottom lip extends along a direction that is parallel to a horizontal direction.

18. The front load washing machine appliance of claim 10, wherein the wash tub includes an outer circumferential surface, wherein the vent inlet of the vent line is positioned coincident with, or immediately adjacent to, a vertical tangent to the outer circumferential surface of the wash tub.

19. The front load washing machine appliance of claim 1, wherein the vent filter further comprises a vent filter casing to which the plurality of louvers are non-rotatably attached.

20. The front load washing machine appliance of claim 10, wherein the vent filter further comprises a vent filter casing to which the plurality of louvers are attached so as to fix the position of each of the plurality of louvers relative to the vent filter casing.

* * * * *